United States Patent [19]

Kalwaites

[11] 4,016,317

[45] Apr. 5, 1977

[54] NONWOVEN FABRIC

[75] Inventor: Frank Kalwaites, Gladstone, N.J.

[73] Assignee: Johnson & Johnson, New Brunswick, N.J.

[22] Filed: Mar. 6, 1975

[21] Appl. No.: 556,024

Related U.S. Application Data

[60] Division of Ser. No. 306,108, Nov. 13, 1972, abandoned, which is a continuation-in-part of Ser. No. 114,449, Feb. 11, 1971, abandoned.

[52] U.S. Cl. ..... 428/88; 428/96; 428/131; 428/137; 428/195; 428/284; 428/910

[51] Int. Cl.[2] ..... D04H 11/00

[58] Field of Search ..... 156/62.2, 72, 252, 272; 28/72.2 F, 78; 19/161 R, 168; 428/224, 296, 198, 113, 131, 137, 96, 284, 88, 286, 299, 195, 196, 236, 255, 910

[56] References Cited

UNITED STATES PATENTS

| | | | |
|---|---|---|---|
| 2,862,251 | 12/1958 | Kalwaites | 19/161 |
| 2,958,608 | 11/1960 | Barnard | 428/141 |
| 3,033,721 | 5/1962 | Kalwaites | 428/224 |
| 3,081,515 | 3/1963 | Griswold et al. | 28/78 |
| 3,193,436 | 7/1965 | Kalwaites | 428/113 |
| 3,266,969 | 8/1966 | Makansi | 428/92 |

*Primary Examiner*—James J. Bell

[57] ABSTRACT

A nonwoven fabric with a layer of fibers of staple length arranged in a predetermined pattern of fiber bundles defining areas of low fiber density and having one surface free of fiber ends and the other having a substantial number of fiber ends bonded with an adhesive to provide strength and stability. The fabric is made by supporting a layer of fibers of staple length on a foraminous support member and applying fiber moving forces to a layer to form areas of low fiber density and fiber bundles while simultaneously causing the ends of fibers to protrude through the opening of the foraminous support. The layer is removed from the support and the fiber ends bonded together to produce my novel nonwoven fabric.

3 Claims, 8 Drawing Figures

NONWOVEN FABRIC

This is a division of application Ser. No. 306,108 filed Nov. 13, 1972 now abandoned, which in turn is a continuation-in-part application of my copending application Ser. No. 114,449 filed Feb. 11, 1971 now abandoned.

This invention relates to a new, improved nonwoven fabric and method and apparatus for producing the same and more specifically to a new type of patterned nonwoven fabric.

BACKGROUND OF INVENTION

Nonwoven fabrics having patterns of areas of low fiber density or holes and patterns of fiber bundles of parallelized consolidated fiber segments, have been known for some time. Such fabrics have had acceptance in the market place and a number of methods and apparatus for producing such fabrics have been developed. Broadly, these fabrics contain a predetermined pattern of areas of low fiber density or holes arranged throughout the fabric. The predetermined pattern of areas of low fiber density or holes is partially or entirely defined by yarn-like fiber bundles; that is, small areas in which fiber segments are consolidated and parallelized along the edges or about the periphery of the holes or areas of low fiber density. The junctures in the fabric; that is, the areas where the fiber bundles intersect one another, may have different configurations. The fibers at these junctures lie in a more or less random configuration with portions of fibers extending to various fiber bundles which enter the intersections. In some instances, the junctures may comprise an area of highly entangled fiber segments. Some of the techniques for manufacturing these fabrics are more fully described in U.S. Pat. No. 2,862,251 to Frank Kalwaites and U.S. Pat. No. 3,485,706 to Franklin James Evans.

Fabrics of the type described above may contain an additive adhesive to improve the strength and other characteristics of the fabric. The adhesive may be printed on in a pattern or the fabric may be overall impregnated with the adhesive. In some instances, the fabric may have adequate strength in the absence of any adhesive.

SUMMARY OF THE PRESENT INVENTION

I have discovered a novel nonwoven fabric which has good strength properties. The opposite surfaces of my new nonwoven fabric have entirely different characteristics. One surface may be highly absorbent while the other surface is repellent or one surface may be very smooth and soft while the other surface has good abrasion resistance and stability or various other combinations of characteristics as desired.

In accordance with the present invention, my new nonwoven fabric comprises a layer of fibers of staple length with the fibers arranged in a predetermined pattern of fiber bundles. The bundles comprise a plurality of fiber segments with the fiber segments consolidated and substantially parallelized. The bundles define a pattern of areas of low fiber density or holes between them. My new fabric has one surface which is smooth and substantially free of fiber ends while the opposite surface contains a plurality of fiber ends held together by a binder to form tufts of bonded fiber ends on this surface.

In accordance with the present invention, my new fabric is made of placing a fibrous web comprising staple length fibers on a foraminous support member. the foraminous support has from about 200 to 8100 openings per square inch to provide from about 20 to 70% open area in the support so that the staple length fibers will span at least two of said openings. While the web is supported, fiber rearranging forces are directed against the fibrous web to move fiber segments into closer proximity to one another and increased parallelism to form fiber bundles defining areas of low fiber density therebetween. Simultaneously, individual fiber ends are forced down through the openings in the foraminous support member The rearranged fibrous web is removed from the foraminous member and adhesive applied to that surface of the web having the protruding fiber ends, bonding the fiber ends together to product a novel nonwoven fabric.

BRIEF DESCRIPTION OF THE DRAWINGS

In the accompanying drawings and the following specification, preferred designs of machines and methods of operation embodying my invention and embodying the fabrics of my invention will be illustrated and described. It is to be understood that the invention is not to be considered limited to the construction or operations disclosed except as determined by the scope of the appended claims.

The invention will be more fully described in conjunction with the accompanying drawings wherein.

DETAILED DESCRIPTION OF SPECIFIC FORMS OF THE INVENTION

Figure 1:
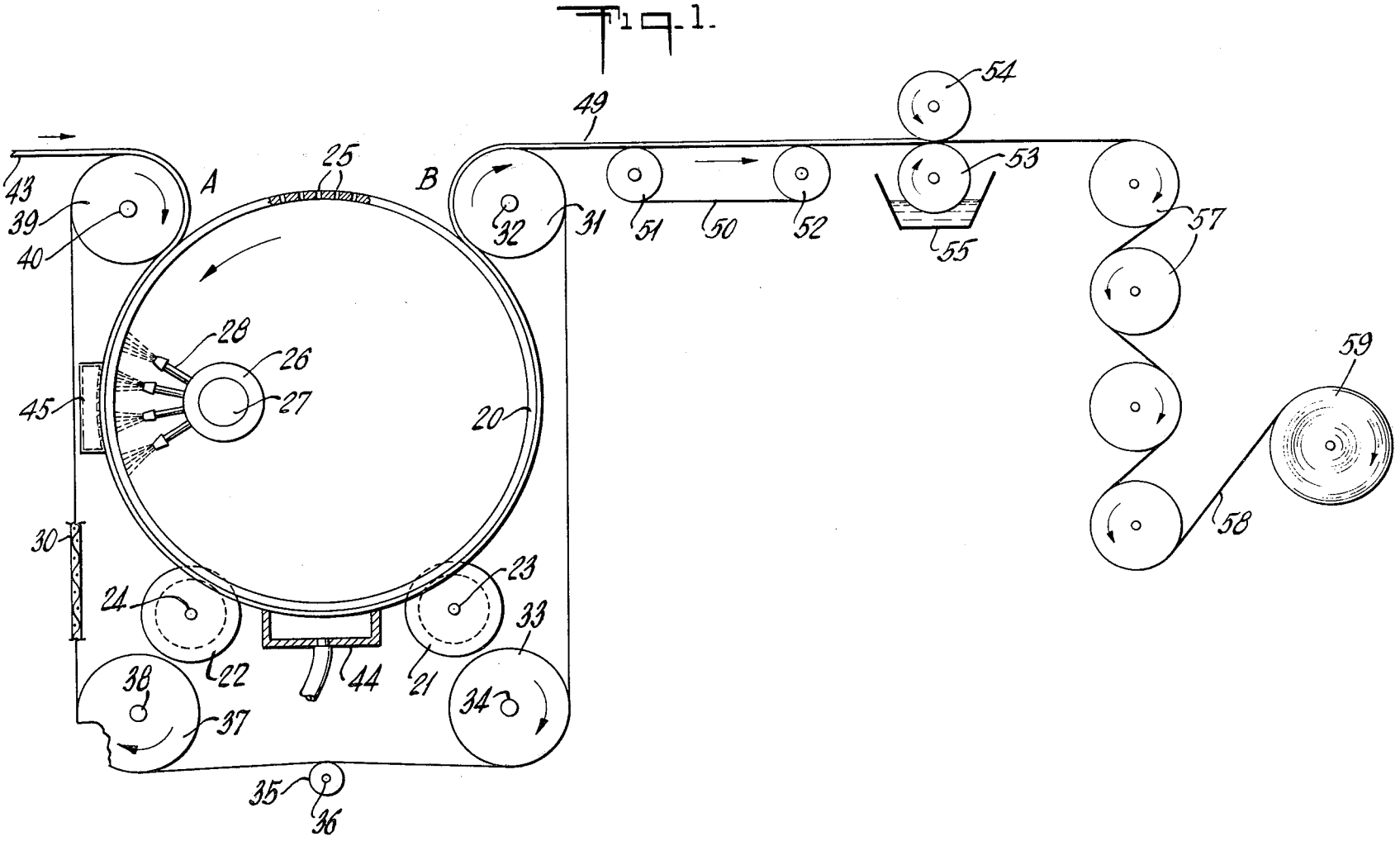
FIG. 1 is a diagrammatic showing in elevation of one type of apparatus employed to produce the product of the present invention.

FIG. 1 shows one form of the apparatus that may be used in accordance with the present invention. full particulars of the basic apparatus of which this apparatus is a specific form including methods of varying rotation, etc. are described in U.S. Pat. No. 2,862,251, issued Dec. 2, 1958, and are incorporated in the present application by reference and need not be described in complete detail here. In view of this reference, the apparatus of FIG. 1 will be described in general terms insofar as its essential elements are the same as within the patent just mentioned and already explained. The novel features used to manufacture nonwoven fabrics in accordance with the present invention will be described in more detail.

The apparatus of FIG. 1 includes a rotatable apertured drum 20 suitably mounted on flanged guide wheels 21 and 22 which are mounted for rotation on shafts 23 and 24. The drum has apertures 25 uniformly spaced over its entire surface with the remaining portion of the drum lying between and connecting the apertures constituting imperforate land areas. The apertures are round and are arranged such that they are aligned in a square pattern over the surface of the drum. The apertures may have any shape desired and the may also be arranged in any discontinuous pattern over the drum; that is, they can be aligned longitudinally and/or transversely, staggered, etc. Inside the drum is a stationary manifold 26 to which a fluid is applied through conduit 27 extending along the full width of the drum. On one side of the manifold directed towards the drum is a series of nozzles 28 for directing the fluid toward the drum.

About the greater portion of the periphery of the drum is positioned a foraminous backing belt 30. This backing belt may be made of course woven fabric but should have sufficient foraminous or open area so that fiber ends can readly protrude through the belt. Belts having from about 200 to 8100 or more openings per square inch and about 20 to 70% open area have been found satisfactory in carrying out the methods of the present invention. The backing belt passes about the drum and separates from the drum at the guide roll 31 which rotates on the shaft 32. The belt passes downwardly around the guide roll 33 rotating on a shaft 34 and then rearwardly over vertically adjustable tensioning and tracking guide roll 25 rotating on a shaft 36 and then around guide roll 37 on a shaft 38. The member passes upwardly and around the guide roll 39 rotating on a shaft 40 to be returned about the periphery of the drum.

The apertured drum and the foraminous backing belt provide a rearranging zone between them through which a fibrous starting material 43 may move to be rearranged, under the influence of applied fluid forces, into a nonwoven fabric having a pattern of fiber bundles defining areas of low fiber density or holes. Tension on the backing belt is controlled and adjusted by the tensioning and tracking guide rolls. The guide rolls are positioned in slidable brackets which are adjustable to assist in the maintenance of the proper tension of the belt. Tension required will depend upon the width of the fibrous web being treated and the amount of rearranging and patterning desired in the final product.

A catch basin 44 is supplied beneath the drum to catch any excess water or fluid discharged from the nozzles.

The apertured drum rotates in the direction of the arrow shown and the foraminous backing belt moves in the same direction at the same peripheral linear speed. The drum and belt rotate in the indicated guide channels in rolls 27 and 22 so that both longitudinal and lateral translatory motion of the backing belt and the apertured drum and the fibrous layer with respect to each other minimized. The fibrous material to be treated is fed between the backing belt and the apertured forming member at poing A, passes through a fiber rearranging zone where fluid rearranging forces are applied to it and is removed between the apertured drum and the backing belt at point B.

As fibrous material passes through the fiber rearranging zone, a liquid, such as water is directed against the inner surface of the apertured drum by nozzles mounted inside the drum. The water passes through the apertures of the drum into the layer of fibrous starting material to produce rearrangement of the fibers and the water then passes through the opening of the foraminous backing belt carrying fiber ends with the water out through these openings.

A vacuum assist box 45 may be located outside the backing belt opposite the manifold and nozzles. The vacuum box has a perforated surface located closely adjacent the surface of the backing belt and through which the suction is caused to act upon the web. Suction is applied not only to assist in the rearrangement of the fibers in the web of material passing through the rearranging zone, but it also helps to dewater the web and aids in bringing the fiber ends out through the openings in the backing member. A drain pan or catch basin 44 is provided so that water deflected by the drum and belt will be carried away from the machine.

The rearranged fibrous web 49 is removed from the backing belt and conveyed by means of an endless conveyor 50 rotating on rolls 51 and 52. The rearranged web passes through a set of print rolls 53 and 54. The bottom or printing roll 53 is engraved in a pattern to apply binder to the web. The pattern on this roll may be in the form of dots, circles, squares, lines, etc., or it may be engraved so that it applies adhesive over the entire surface of the web. This print roll 53 has its bottom portion submersed in a trough 55 of adhesive. As the roll rotates, it picks up the adhesive and applies it to the bottom surface of the rearranged fabric. The bottom surface of the rearranged fabric is that surface which has many fiber ends protruding from it. The top roll 54 maintains the web in contact with the print roll, to insure pick-up of binder. The binder is applied only to the bottom surface of the fabric and in many instances, only to the protruding fiber ends or tufts of fiber ends.

The web with the binder printed on it, passes through a series of dry cans 57 to dry the binder and produce a non-woven fabric 58. The fabric is rolled up by standard wind-up means 59.

Figure 2:
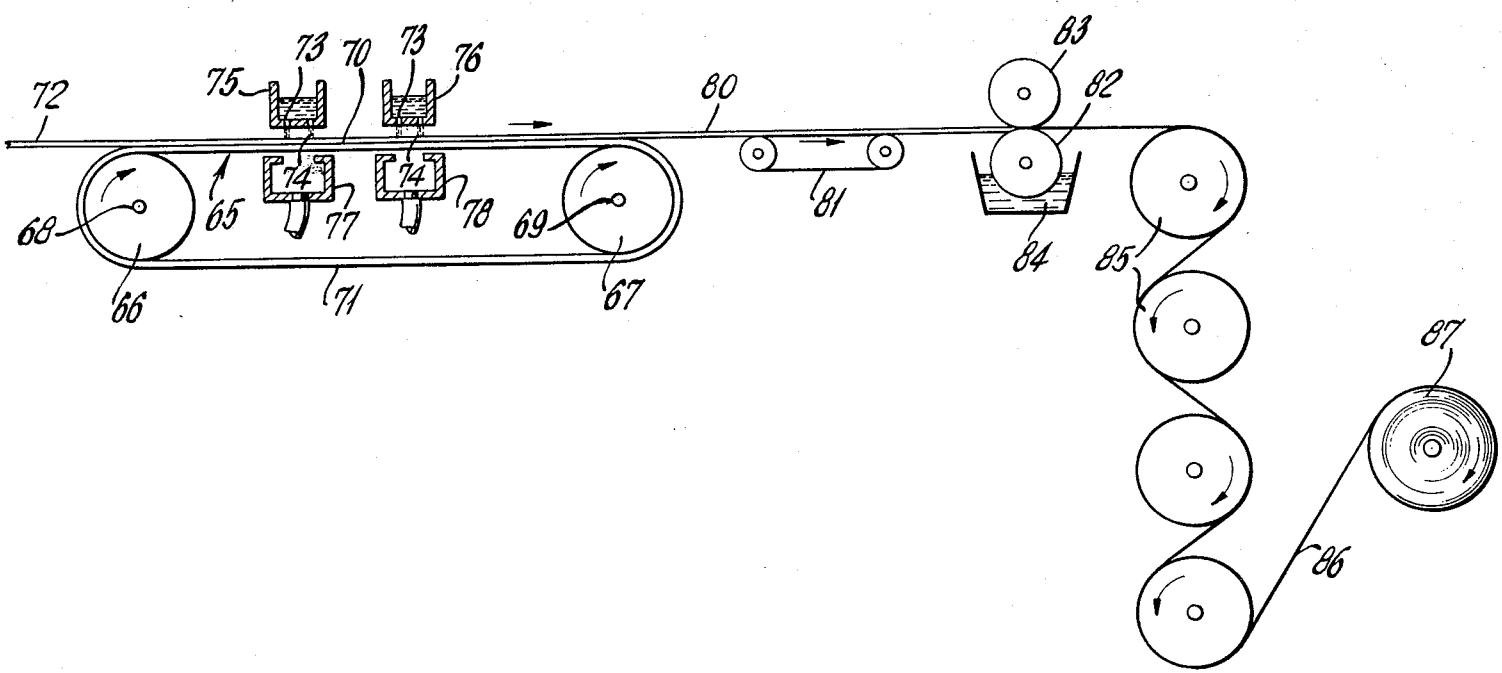
FIG. 2 is a diagrammatic showing in elevation of another type of apparatus to be employed to produce the products of the present invention.

Referring to FIG. 2 of the drawings, there is shown another form of apparatus for producing the products of the present invention. In this embodiment, the foraminous backing means 65 is in the form of an endless conveyor. The conveyor rotates about rolls 66 and 67 rotating on shafts 68 and 69 to form an upper reach 70 and a lower reach 71. The web 72 to be treated is carried along the upper reach of the conveyor. Positioned just above the upper reach is a plurality of jets 73. The jets apply columnar streams of water 74 to the fibrous web. The jets may be stationary or they may be movable so that they transverse across the web. The jets are in rows and these rows may be aligned or staggered as desired. Water, at pressures of from atmospheric pressure to 5000 pounds is carried in the headers 75 and 76 and directed against the fibrous web through the fine jets. Beneath the upper reach are vacuum clots 77 and 78 to gather the water after it has acted on the web.

The backing means must be sufficiently open so that the fiber ends in the fibrous web are directed out through the openings. The vacuum aids in pulling these fiber ends through the openings in the foraminous backing means. Water, directed against the web and out through the foraminous backing means applies fluid rearranging forces to the web which move fiber segments into closer proximity and increased parallelism to form fiber bundles. These forces also act on the web to form areas of high entanglement of fibers which connect the fiber bundles. It is in these areas of high entanglement of fibers that fiber ends are forced to protrude out through the openings of the foraminous backing means.

The rearranged fibrous web 80 is removed from the foraminous backing means and carried by a second conveyor 81 to a pair of print rolls, 82 and 83. The bottom print roll 82 is submerged in a trough 84 carrying the adhesive to be applied to the web. The print roll 82 may be engraved in any desired pattern as previously described. The upper print roll 83 maintains the web in contact with the lower roll to insure the application of binder. Binder is applied to the fiber ends protruding from the bottom surface of the web. The web with the binder thereon, passes through a series of dry cans 85 to dry the binder and produce a nonwoven fabric 86. The fabric is wound up on a standard wind-up mechanism 87.

In producing the fabrics of the present invention, virtually any fluid may be used though water is preferred for ease of handling and economic reasons. Also a patterned foraminous backing means may be used and an apertured forming means may be used or omitted as desired.

The fluid may be applied either by spray jets which cover the entire surface of the web being treated or by columnar streams of water; that is, streams which do not break up but impinge on the web as a stream.

The important criteria for producing the fabrics of the present invention are: to apply the fluid forces on only one side of the web; to utilize fibers of sufficient length so that the fiber ends protrude through the openings in the backing means and to use a backing means having from about 200 to 8100 openings per square inch with the backing means having an open area of from 20 to 70% so that the ends of the fibers will protrude through the openings.

After the web is produced having a substantial number of fiber ends on one surface, the binder is applied to that surface. If water is being used, it is preferred that the greater portion of the water be removed from the web before the binder is applied to prevent the binder from spreading over and throughout the entire web. The spread of binder may also be controlled by coating just a surface of the web. For the most part, the fiber ends have more attraction for the binder and hence when applying the binder, it unexpectedly apparently has much greater affinity for the fiber ends than for any other portion of the fabric and it is these fiber ends which require the bonding rather than the other areas of the fabric in which the fibers are more efficiently used. This technique produces a two-surface fabric which has very good strength properties and varying surface properties depending on the fibers and binder used.

Figure 3:
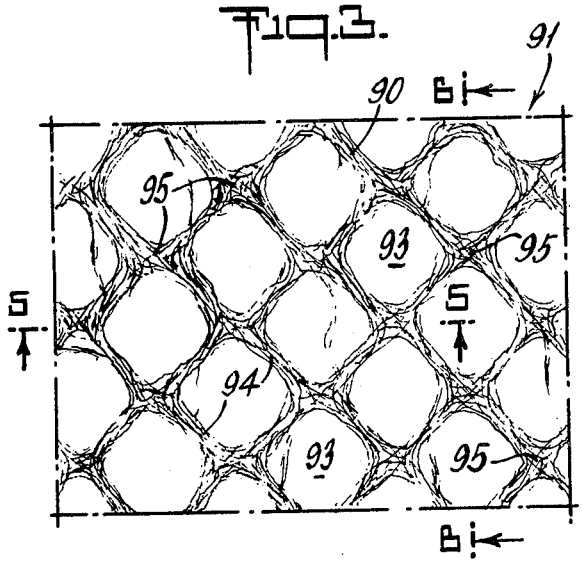
FIG. 3 is a schematic plan view of one surface of one type of fabric according to the present invention.
Figure 4:
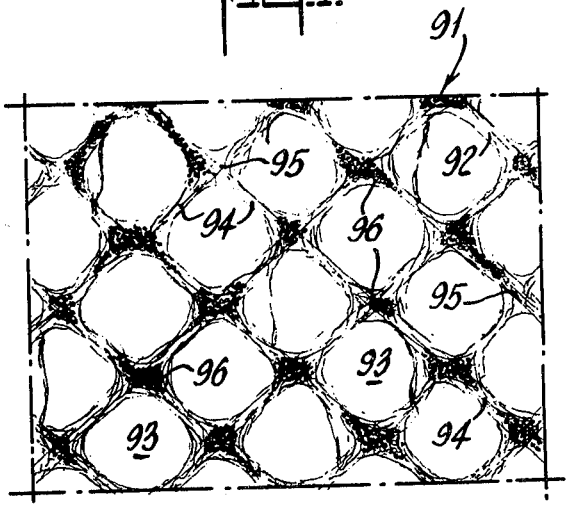
FIG. 4 is a schematic plan view of the other surface of the fabric of FIG. 3.
Figure 5:
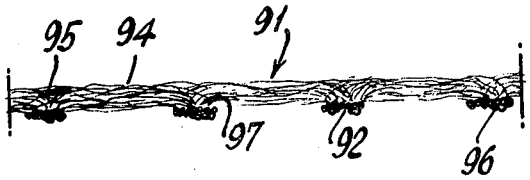
FIG. 5 is a cross-sectional view taken along line 5—5 of FIG. 3.
Figure 6:
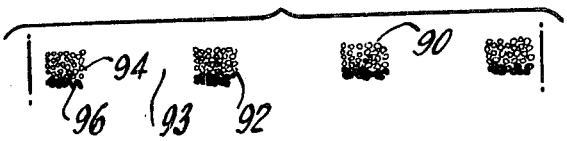
FIG. 6 is a cross-sectional view taken along line 6—6 of FIG. 3.

In FIGS. 3, 4, 5, and 6, there is shown one embodiment of a nonwoven fabric of the present invention. FIG. 3 shows the top surface 90 of the fabric 91 and FIG. 4, the opposite surface 92 of the fabric 91 whereas FIGS. 5 and 6 are cross-sectional views of the fabric 91.

Referring to FIG. 3, the fibers are arranged to form a pattern of areas of low fiber density 93; in this instance, holes. The portions of the fibers about the periphery of the holes are in close proximity and in substantial alignment with each other to form yarn-like fiber bundles 94 which define the holes. As a square pattern of holes is shown, the fiber bundles meet at the center point 95 formed by four holes and form a juncture at this point wherein the fibers are in a random configuration and are entangled to some degree. As is seen in FIGS. 3 and 5, the surface 90 of the fabric contains very few, if ay, fiber ends and the surface has smooth longitudinal portions or curved edges of fibers which form the entire surface. Contrasted to this, in FIG. 4, there are still the fiber bundles 94 and junctures or center points 95 as described in conjunction with FIG. 3, however, there are many fiber ends, most of which extend from the juncture area and there is also a binder 96 applied to the surface 92 which has migrated to the fiber ends. As is shown in FIGS. 5 and 6 the fabric is defined by opposed generally parallel planar surfaces with the yarn-like fiber bundles 94 disposed or located between these surfaces.

As is seen in FIGS. 4, 5, and 6, the binder is in the form of a small fine particles which encircle or encase a number of fiber ends to hold the ends together. The tufts 97 of fibers which have been bonded are more clearly shown in FIG. 5 and generally extend out of the general plane of the fabric. The cross-section shown in FIG. 6 which is at 90° to that shown in FIG. 5, shows the parallelism and consolidation of the fibers to form fiber bundles between the apertures or openings.

Figure 7:
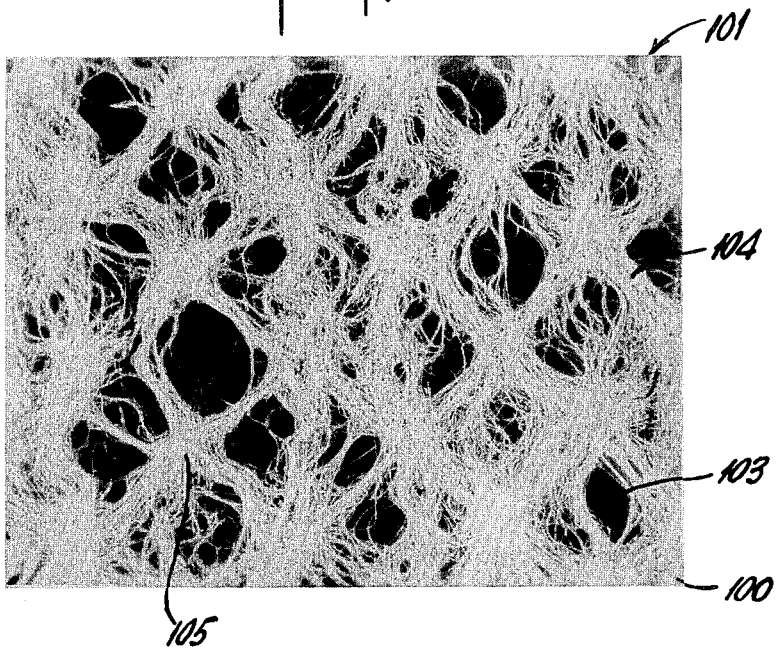
FIG. 7 is a photomicrograph of a nonwoven fabric in accordance with the present invention at an original enlargement of five times taken from one side of the fabric.
Figure 8:
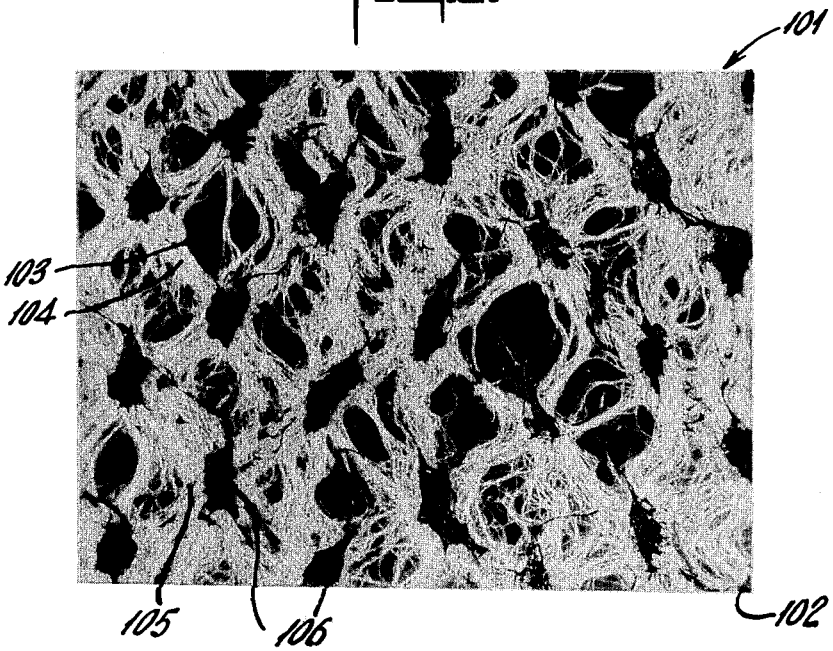
FIG. 8 is a photomicroraph of the other side of the nonwoven fabric shown in FIG. 7.

In FIGS. 7 and 8, there are shown photomicrographs of a fabric of the present invention, FIG. 7 being the smooth surface 100 of the fabric 101 and FIG. 8 being the opposite or bonded surfaces 102 of the fabric 101. The fabric comprises openings 103 or areas of low fiber density which are defined by fiber bundles 104. The fiber bundles comprise fiber segments of consolidated, substantially parallelized fiber portions. The bundles meet at intersections or juncture 105 and the fiber segments now become randomly laid in the juncture. Referring to FIG. 8, the binder particles 106 are located primarily at the junctures 105 and have encased or adhered fiber ends to each other and to the fabric itself.

The starting fibrous web may consist of any web or batt of loose, fibrous elements of staple length disposed in relatively random relationship with one another or in any degree of alignment such as may be produced by carding, air-laid, wet-laid, and the like. By staple length fibers it is meant fibers having a length of one-fourth inch or more up to a few inches. The fibers must have a length so as to span at least two adjacent openings. This length allows the opposite ends of the fiber to enter different openings during the process and provides for strength and integrity in the fabric. The exact length used will, of course, depend on the size and number of openings in the support member. The fibers themselves may be any of the natural, artificial, or synthetic fibers such as cotton, rayon, polyesters, polyamides, etc.

The binders used may be any of the standard binders used in the manufacture of nonwoven fabrics such as the polyvinyl acetates, the polyvinyl chlorides, the acrylics, etc.

The optimum binder content for a given fabric, according to this invention, depends upon a number of factors including the nature of the binder material, the size and shape of the binder members and their arrangement in the fabric, the nature and length of the fibers, total fiber weight and the like. The following are illustrative Examples of the fabrics produced in accordance with the method and apparatus of this present invention;

EXAMPLE I

In apparatus as illustrated in FIG. 1, a web of loosely assembled fibers such as may be obtained by carding, is fed between an apertured drum 20 and foraminous backing means 30. The web weight is about 450 grains per square yard and has a fiber orientation ratio of approximately 7 to 1 in the direction of travel. The web contains viscose rayon fibers approximately 1 9/16 inches long of 1 ½ denier.

The apertured drum used in this Example has about 165 substantially round holes per square inch, each approximately 0.045 inch in diameter. The holes are arranged in a diamond pattern over the drum and each aperture 25 is spaced approximately 0.040 inches in the diagonal direction from the immediately adjacent aperture in the drum.

The foraminous backing belt 30 comprises a woven nylon screen having approximately 8100 opening per square inch with about 60 percent open area.

Water is projected from nozzles 28 through the apertures 25 of the drum and then through the fibrous web and foraminous portions of the backing belt into the vacuum assist box 45. As the fibrous web passes through the rearranging zone, streams of water are directed against it as just described. The rotation of the sandwich; comprised of the apertured drum, rearranging fabric, and backing belt, brings the rearranged fabric to take-off zone B. At this point, the rearranged nonwoven fabric 49 leaves the apparatus. With the conditions indicated, good fiber rearrangement and bundling are obtained and loose fiber ends are pushed out through the openings in the backing belt. The bottom surface of the resultant fabric has many fiber ends extending in tufts from this surface. The rearranged web is passed through a pair of print rolls 53 and 54 as shown in FIG. 1. The bottom print roll is engraved in a pattern of diagonal lines. There are 23 lines per inch which are engraved at a 15° angle to the axis of the roll. The roll 53 rotates in a trough 55 of binder. A polyvinyl chloride binder is used. The upper roll 54 is smooth and is in contact with the upper or smooth surface of the fabric. The binder is picked up by the engraved roll and applied to the tufted fiber ends of the rearranged fabric. The fabric is dried at 220° F. by passing the fabric over a set of dry cans 57 and the fabric wound up.

The fabric produced has one surface which is very smooth, soft and highly absorbent as it comprises substantially 100% rayon fiber. The fabric is strong, has good toughness and its opposite surface has good frictional properties. The fabric makes a very good cover for an absorvent core when the surface containing the binder is in contact with the core. The binder stabilizes any motion between the cover and the core and the outer surface of the cover having no binder is very smooth and highly absorbent.

EXAMPLE II

In apparatus as illustrated in FIG. 2, a web of loosely assembled fibers such as may be obtained by air-laying, is fed onto a foraminous backing member 65. The web weighs about 450 grains per square yard and contains polyester fibers approximately 1½ inch long of 1½ denier. The foraminous belt used in this Example has about 225 openings per square inch. The belt is a woven wire screen about 15 × 15 with about 35 percent open area.

Above the belt and directed against the upper reach 70 of the belt, are two water-jet manifolds 75 and 76. Each manifold consists of two rows of orifices. The orifices are staggered in adjacent rows and each orifice has a diameter of 0.012 inch. Water, at 200 pounds pressure, is directed through orifices onto the web while the web is supported by the foraminous backing means. The water is removed by the vacuum boxes 77 and 78 beneath the upper reach of the backing means. The vacuum applies about 2 inches of mercury. The web, as it passes under the water jets, is rearranged into a pattern of fiber bundles with entangled junctures connecting the fiber bundles. Fiber ends are pushed out through the openings in the backing belt at the areas of the entangled junctures. The rearranged web is removed from the belt and passed through the nip of a pair of print rolls 82 and 83. The upper roll 83 is smooth and maintains the web in contact with the lower roll 82. The lower roll is an overall impregnating roll and contains about 900 depressions or cells per square inch with each cell about 0.009 inches deep. The roll rotates in a bath of acrylic binder so that all of the cells are filled with acrylic binder. The roll containing binder contacts the lower portion of the fabric and applies the binder to the tufted fiber ends. The fabric passes through a series of dry cans 85 to dry the binder and produce a nonwoven fabric in accordance with the present invention.

The above detailed description has been given for clearness of understanding only. No unnecessary limitations should be understood therefrom as modifications will be obvious to one skilled in the art.

I claim:

1. A nonwoven fabric comprising a layer of staple length fibers arranged in a predetermined pattern of yarn-like fiber bundles, said bundles comprising a plurality of fiber segments with the segments being consolidated and in a substantial parallelism within each bundle, opposite ends of each fiber included within different bundles so that substantially all fiber ends protrude from one surface of the fabric, said fiber bundles defining a predetermined pattern of areas of low fiber density throughout the fabric, said bundles being located between spaced generally parallel planes generally defining the opposed surfaces of the fabric, and a binder material on one surface of the fabric adhereing fiber ends on said surface together to provide a fabric strength, the opposite surface of the fabric being substantially free of fiber ends and being completely free of binder material.

2. The nonwoven fabric of claim 1 wherein the areas of low fiber density are openings.

3. The nonwoven fabric of claim 1 wherein the binder material is arranged in a predetermined pattern of discontinuous binder areas.

* * * * *

UNITED STATES PATENT AND TRADEMARK OFFICE

CERTIFICATE OF CORRECTION

PATENT NO. : 4,016,317

DATED : April 5,1977

INVENTOR(S) : Frank Kalwaites

It is certified that error appears in the above-identified patent and that said Letters Patent are hereby corrected as shown below:

In Column 2, line 4, "the" should read -- The --.

In Column 2, line 14, after "member" insert -- . --.

In Column 2, line 17, "product" should read -- produce --.

In Column 3, line 11, "the" should read -- they --.

In Column 3, line 62, "poing" should read -- point --.

In Column 4, line 59, "clots" should read -- slots --.

In Column 6, line 5, "ay" should read -- any --.

In Column 6, line 19, "of a small" should read -- of small --.

In Column 6, line 31, "surfaces" should read -- surface --.

UNITED STATES PATENT AND TRADEMARK OFFICE

CERTIFICATE OF CORRECTION

PATENT NO. : 4,016,317

DATED : April 5,1977

INVENTOR(S) : Frank Kalwaites

It is certified that error appears in the above-identified patent and that said Letters Patent are hereby corrected as shown below:

In Column 7, line 54, "absorvent" should read -- be absorbent--.

In Column 8, line 54, "provide a fabric" should read -- provide fabric --.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*